US006930581B2

(12) United States Patent
Martis et al.

(10) Patent No.: US 6,930,581 B2
(45) Date of Patent: Aug. 16, 2005

(54) CURRENT TRANSFORMER HAVING AN AMORPHOUS FE-BASED CORE

(75) Inventors: Ronald J. Martis, East Hanover, NJ (US); Ryusuke Hasegawa, Morristown, NJ (US); Seshu V. Tatikola, Bridgewater, NJ (US)

(73) Assignee: Metglas, Inc., Conway, SC (US)

( * ) Notice: Subject to any disclaimer, the term of this patent is extended or adjusted under 35 U.S.C. 154(b) by 558 days.

(21) Appl. No.: 10/071,682

(22) Filed: Feb. 8, 2002

(65) Prior Publication Data

US 2003/0151483 A1 Aug. 14, 2003

(51) Int. Cl.[7] ..... H01F 27/28

(52) U.S. Cl. ..... 336/182; 336/90; 336/178; 336/212; 336/213; 336/233

(58) Field of Search ..... 336/90, 178, 212, 336/213, 233, 83, 92, 234, 198; 148/108

(56) References Cited

U.S. PATENT DOCUMENTS

| | | | | |
|---|---|---|---|---|
| 3,856,513 A | | 12/1974 | Chen et al. | 75/122 |
| 4,812,181 A | | 3/1989 | Hilzinger et al. | 148/121 |
| 5,110,378 A | | 5/1992 | Hasegawa et al. | 148/304 |
| 5,200,002 A | | 4/1993 | Hilzinger | 148/304 |
| 5,284,528 A | | 2/1994 | Hasegawa et al. | 148/304 |
| 5,871,593 A | | 2/1999 | Fish et al. | 148/304 |
| 6,093,261 A | * | 7/2000 | Hasegawa et al. | 148/304 |
| 6,137,412 A | | 10/2000 | Herzer | 340/572.6 |
| 6,144,279 A | | 11/2000 | Collins et al. | 136/178 |
| 6,211,765 B1 | * | 4/2001 | Ito et al. | 336/178 |
| 6,507,262 B1 | * | 1/2003 | Otte et al. | 336/213 |

FOREIGN PATENT DOCUMENTS

| | | | |
|---|---|---|---|
| CN | 1050109 | 3/1991 | H01F/1/153 |
| EP | 0092091 | 4/1983 | H01F/1/06 |
| JP | 59181504 | 10/1984 | H01F/1/14 |
| JP | 61261451 | 5/1985 | |
| JP | 63299219 | 5/1987 | H01F/10/14 |
| RU | 2044799 | 8/1992 | C22C/45/00 |
| WO | WO 0030132 | 5/2000 | H01F/38/28 |

* cited by examiner

*Primary Examiner*—Elvin Enad
*Assistant Examiner*—Jennifer A. Poker
(74) *Attorney, Agent, or Firm*—Ernest D. Buff & Associates, LLC; Ernest D. Buff; Gordon E Fish

(57) ABSTRACT

A magnetic core has a toroidal configuration, formed by winding an iron-based amorphous metal ribbon. Thereafter the core is heat-treated to achieve a linear B-H characteristic. Advantageously, the linear B-H characteristic does not change with the level of magnetic fields applied and the frequency utilized. With such properties, the core is especially suited for use in a current transformer.

7 Claims, 5 Drawing Sheets

CURRENT TRANSFORMER HAVING AN AMORPHOUS FE-BASED CORE

RELATED U.S. APPLICATION DATA

This application is related to U.S. patent application Ser. No. 10/071,990 filed Feb. 8, 2002, for "Fe-Based Amorphous Metal Alloy Having A Linear B-H Loop" and to U.S. patent application Ser. No. 10/071,368 filed Feb. 8, 2002, for "Filter Circuit Having An Fe-Based Core," both of which are assigned to the assignee of the present application.

BACKGROUND OF THE INVENTION

1. Field of the Invention

The present invention relates to transformers for electrical power distribution systems, power supplies, electromagnetic machinery and the like; and, more particularly, to a current transformer for precision measurement of electrical current, in which the core material responds linearly to the level of magnetic excitation.

2. Description of the Prior Art

Direct measurement of electrical current flowing in a conductive media such as copper wire is not straightforward, especially when the current level and the voltage at the media are high. Indirect measurement methods include conventional electrical meters based on monitoring eddy current generated by an electrical current flow, use of current dividers in which a low current flowing section is comprised of a precision resistor, and magnetic flux meters detecting changes in the magnetic fields generated by an electrical current flow. All of these techniques have drawbacks. For example, eddy-current based conventional electrical meters are not accurate, especially when the current to be measured contains higher harmonics of the fundamental current frequency. The current dividers are hazardous when the current line voltage is high. Magnetic flux meters are widely used, in which the flux generated by a current is detected by a Hall effect sensor or a sensing coil. In both cases, a flux concentrator with a high magnetic permeability is generally utilized to improve sensitivity. To achieve a high degree of accuracy, the magnetic permeability has to be such that the magnetic flux generated in the flux concentrator is directly proportional to the magnetic field caused by the current to be measured. Such a magnetic concentrator is usually a soft magnetic material having a highly linear B-H characteristic where B is the magnetic flux density and H is the magnetic field generated by an electrical current flowing orthogonally with respect to the direction of the magnetic flux.

A linear B-H characteristic is generally obtained in a soft magnetic material in which the material's magnetically easy axis lies perpendicular to the direction of the magnetic excitation. In such a material, the external magnetic field H tends to tilt the average direction of the magnetic flux B such that the measured quantity B is proportional to H. Since the field H is proportional to the electrical current to be measured, the flux B is directly proportional to the current. Most of the magnetic materials, however, have nonlinear B-H characteristics and ideal linear B-H characteristics are difficult to achieve. Any deviation from an ideal B-H linearity introduces inaccuracies in the measurement of electrical current using magnetic flux meters.

A classical example of magnetic materials showing linear B-H characteristics is a cold rolled 50% Fe—Ni alloy called Isoperm. Among amorphous magnetic alloys, heat-treated Co-rich alloys have been known to provide linear B-H characteristics and are currently used as the magnetic core materials in current transformers. The Co-rich amorphous alloys in general have saturation inductions lower than about 10 kG or 1 tesla, which limits the maximum current levels to be measured. Besides, these alloys are expensive owing to the large amount of Co used to form the alloys. Clearly needed are inexpensive alloys having saturation inductions higher than 10 kG (1 tesla), which exhibit linear B-H characteristics.

Amorphous metal alloys have been disclosed in U.S. Pat. No. 3,856,513, issued 24 Dec. 1974 to Chen and Polk. These alloys include compositions having the formula $M_aY_bZ_c$, where M is a metal selected from the group consisting of iron, nickel, cobalt, vanadium and chromium, Y is an element selected from the group consisting of phosphorous, boron and carbon and Z is an element selected from the group consisting of aluminum, silicon, tin, germanium, indium, antimony and beryllium, "a" ranges from about 60 to 90 atom percent, "b" ranges from about 10 to 30 atom percent and "c" ranges from about 0.1 to 15 atom percent. Also disclosed are amorphous metal wires having the formula $T_iX_j$, where T is at least one transition metal and X is an element selected from the group consisting of phosphorus, boron, carbon, aluminum, silicon, tin, germanium, indium, beryllium and antimony, "i" ranges from about 70 to 87 atom percent and "j" ranges from 13 to 30 atom percent. Such materials are conveniently prepared by rapid quenching from the melt using processing techniques that are well known in the art.

These disclosures mention unusual or unique magnetic properties for many amorphous metal alloys, which are generally discussed and defined therein. However, amorphous metal alloys possessing a combination of linear BH characteristics and the saturation inductions exceeding about 10 kG (1 tesla) are required for specific applications such as current/voltage transformers.

SUMMARY OF THE INVENTION

The present invention provides a magnetic core especially suited for use in a current transformer. Advantageously, the core has a linear B-H characteristic which does not change with the level of magnetic fields applied and the frequency utilized. Generally, the core has a toroidal configuration, formed by winding an iron-based amorphous alloy ribbon. Thereafter, the core is heat-treated to achieve a linear B-H characteristic. The iron-based amorphous alloy ribbon is produced by rapid quenching from the melt and has a composition consisting essentially of about 70–87 atom percent iron of which up to about 20 atom percent of iron is replaced by cobalt and up to about 3 atom percent of iron is replaced by nickel, manganese, vanadium, titanium or molybdenum, and about 13–30 atom percent of elements selected from the group consisting of boron, silicon and carbon.

In one embodiment, the invention comprises a core-coil assembly. A copper winding having two leads is wound on the toroidal core. The two leads are connected to a voltmeter. A copper wire is inserted into the central ID section of the core or wound on the core and is connected to a current source. Means are provided for varying the output current of the current source and for monitoring the voltmeter reading to assure that the reading was directly proportional to the current supplied from the current source.

BRIEF DESCRIPTION OF THE DRAWINGS

The invention will be more fully understood and further advantages will become apparent when reference is had to the following detailed description and the accompanying drawings, wherein like reference numerals denote similar elements throughout the several views and in which.

DESCRIPTION OF THE PREFERRED EMBODIMENTS

An iron-based amorphous alloy ribbon was wound in a toroidal shape to form a magnetic core. The core was then heat-treated in an oven with or without a magnetic field. The core was then examined using a commercially available BH hysteresigraph to ascertain a linear B-H relationship, where B and H stand for magnetic induction and magnetic field, respectively. The iron-based amorphous alloy ribbon is produced by rapid quenching from the melt and has a composition consisting essentially of about 70–87 atom percent iron of which up to about 20 atom percent of iron is replaced by cobalt and up to about 3 atom percent of iron is replaced by nickel, manganese, vanadium, titanium or molybdenum, and about 13–30 atom percent of elements selected from the group consisting of boron, silicon and carbon.

Figure 1:
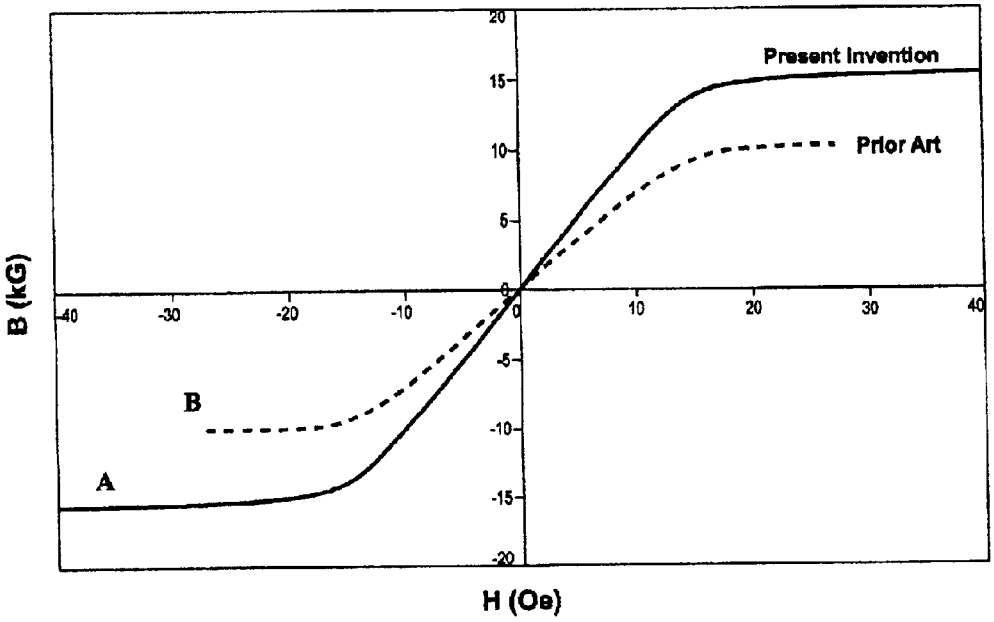
FIG. 1 is a graph depicting the B-H characteristics of an amorphous Fe-based core of the present invention and a prior art core composed of an amorphous Co-based alloy.
Figure 2:
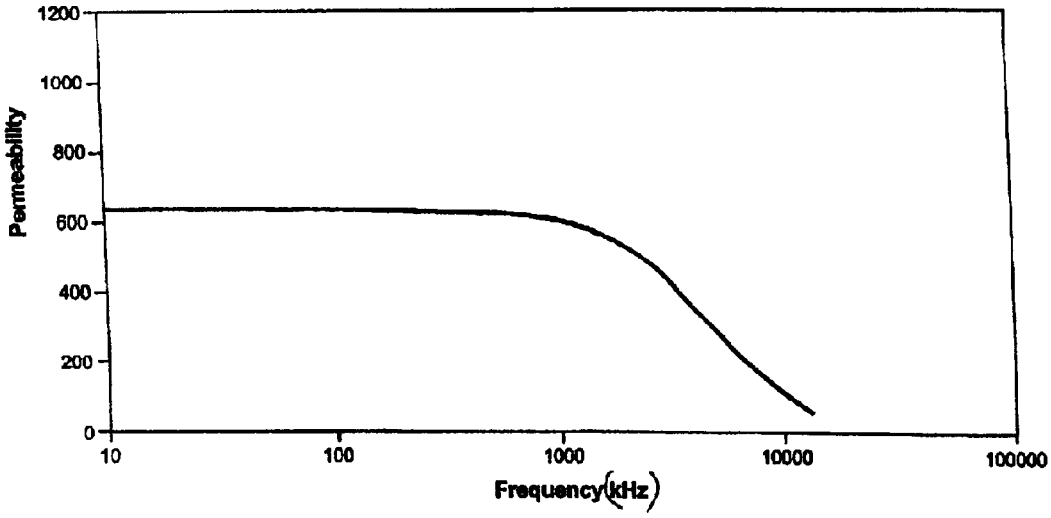
FIG. 2 is a graph depicting the permeability of an amorphous Fe-based core of the present invention as a function of frequency.

FIG. 1 compares the B-H characteristics of an amorphous Fe-based core according to the present invention which was heat-treated at 400° C. for 10 hours with a magnetic field of 200 applied perpendicularly to the toroidal core's circumference direction and a prior art Co-based core. The B-H behavior of the core of the present invention is linear within an applied field of −15 Oe (−1,200 A/m) and +15 Oe (+1,200 A/m) with an accompanying magnetic induction or flux change from −12 kG (−1.2 T) to +12 kG (+1.2 T). The linear B-H region of a prior art Co-based core on the other hand is limited to within a flux change from −7 kG to +7 kG, which limits the current measuring capability. A linear B-H characteristic means a linear magnetic permeability which is defined by B/H. FIG. 2 shows that the permeability of an amorphous Fe-based core of the present invention is constant up to a frequency of about 1000 kHz or 1 MHz. This means that the accuracy of a current transformer of the present invention can be maintained at a certain level throughout the entire frequency range up to about 1000 kHz.

Figure 3:
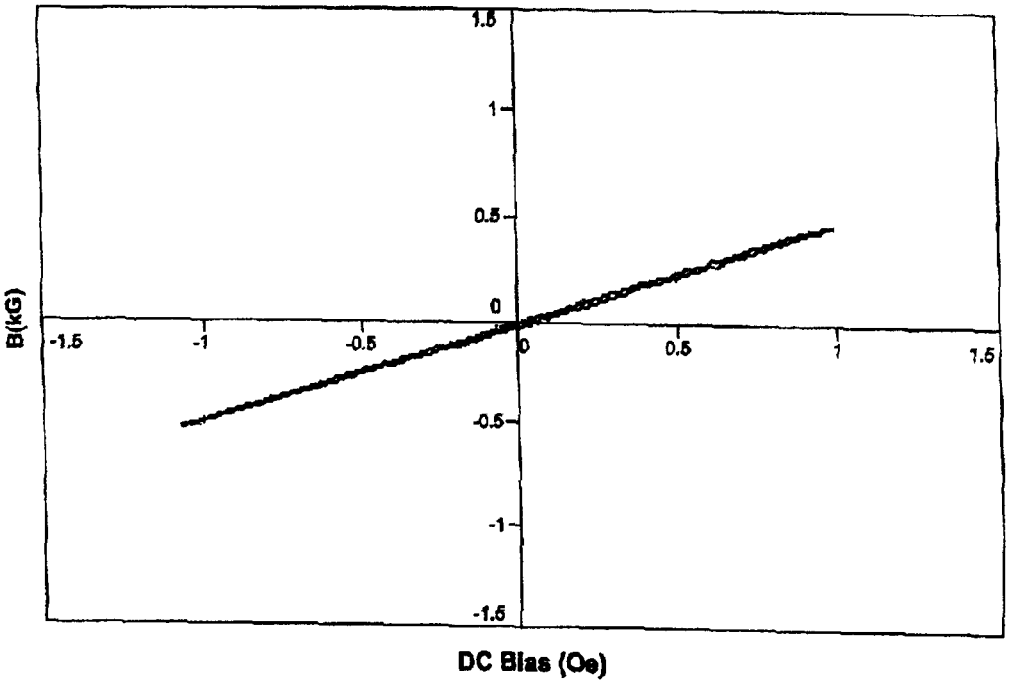
FIG. 3 is a graph depicting a B-H characteristic for an amorphous Fe-based core of the present invention heat-treated at 420° C. for 6.5 hours without an applied field.

A linear B-H behavior was found for an external field of less than about 3 Oe (240 A/m) in a partially crystallized Fe-based amorphous alloy core as shown in FIG. 3. In this case magnetic field during heat-treatment was optional. This core provides a current transformer for sensing low current levels.

Figure 4:
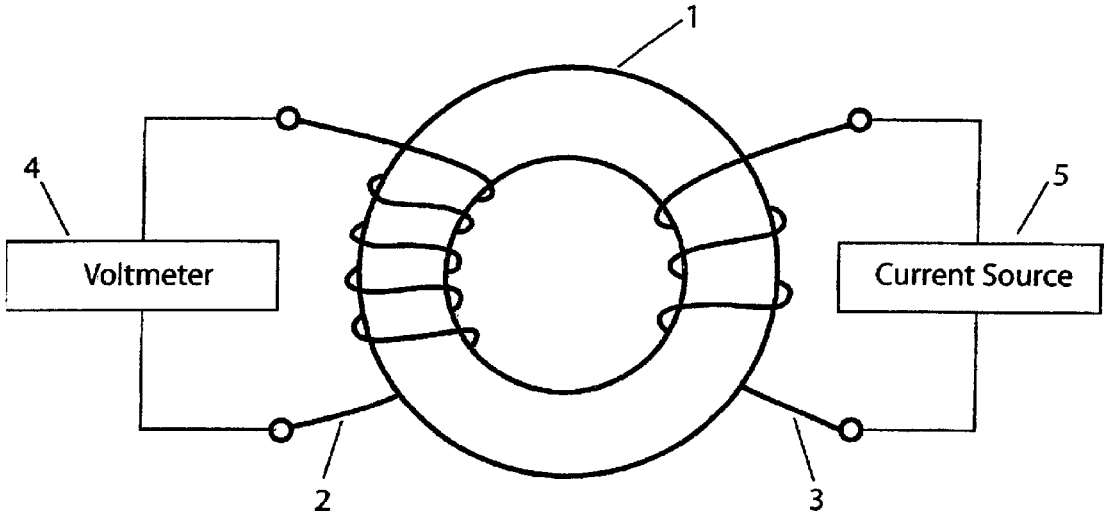
FIG. 4 is a perspective view depicting a current transformer of the present invention.

FIG. 4 shows an example of a current transformer according to the present invention which comprised of an amorphous Fe-based core 1, a copper winding 2 for voltage measurement and a current carrying wire 3. The two leads from copper winding 2 were connected to a voltmeter 4. The current in the current-carrying wire 3 was supplied by a current source 5. The output voltage measured by the volt meter 4 is plotted in FIG. 5 for an amorphous Fe—B—Si—C based core with a saturation induction of 1.6 T (curve A) and an amorphous Fe—B—Si based core with a saturation induction of 1.56 T (curve B). The linearity maintained between the current and output voltage measured in the copper winding is essential to accurate monitoring of the current.

The following examples are presented to provide a more complete understanding of the invention. The specific techniques, conditions, materials, proportions and reported data set forth to illustrate the principles and practice of the invention are exemplary and should not be construed as limiting the scope of the invention.

EXAMPLES

Example 1

Sample Preparation

Amorphous alloys were rapidly quenched from the melt with a cooling rate of approximately $10^6$ K/s following the techniques taught by Chen et al in U.S. Pat. No. 3,856,513. The resulting ribbons, typically 10 to 30 $\mu$m thick and about 1 cm to about 20 cm wide, were determined to be free of significant crystallinity by x-ray diffractometry (using Cu—K$\alpha$ radiation) and differential scanning calorimetry. In ribbon form, the amorphous alloys were strong, shiny, hard and ductile.

Ribbons thus produced were slit into narrower ribbons which, in turn, were wound in toroidal shapes with different dimensions. The toroidal cores were heat-treated with or without a magnetic field in an oven with temperatures between 300 and 450° C. When a magnetic field was applied during heat-treatment, its direction was along the transverse direction of a toroid's circumference direction. Typical field strengths were 50–2,000 Oe (4,000–160,000 A/m).

Example 2

Magnetic Measurements

A toroidal core prepared in accordance with Example 1 was tested in a conventional BH hysteresigraph to obtain B-H characteristics of the core similar to that of FIG. 4. One of the toroidally-shaped cores had dimensions of OD=13.9 mm, ID=9.5 mm and Height=4.8 mm, and the other OD=25.5 mm, ID=16.5 mm and Height=9.5 mm. The magnetic permeability defined as B/H was measured on the toroidal core as a function of dc bias field and frequency, which resulted in the curve shown in FIG. 2. A copper wire winding 50–150 turns was applied on the toroidal core to make an inductor.

Example 3

Current Measurements

Figure 5:
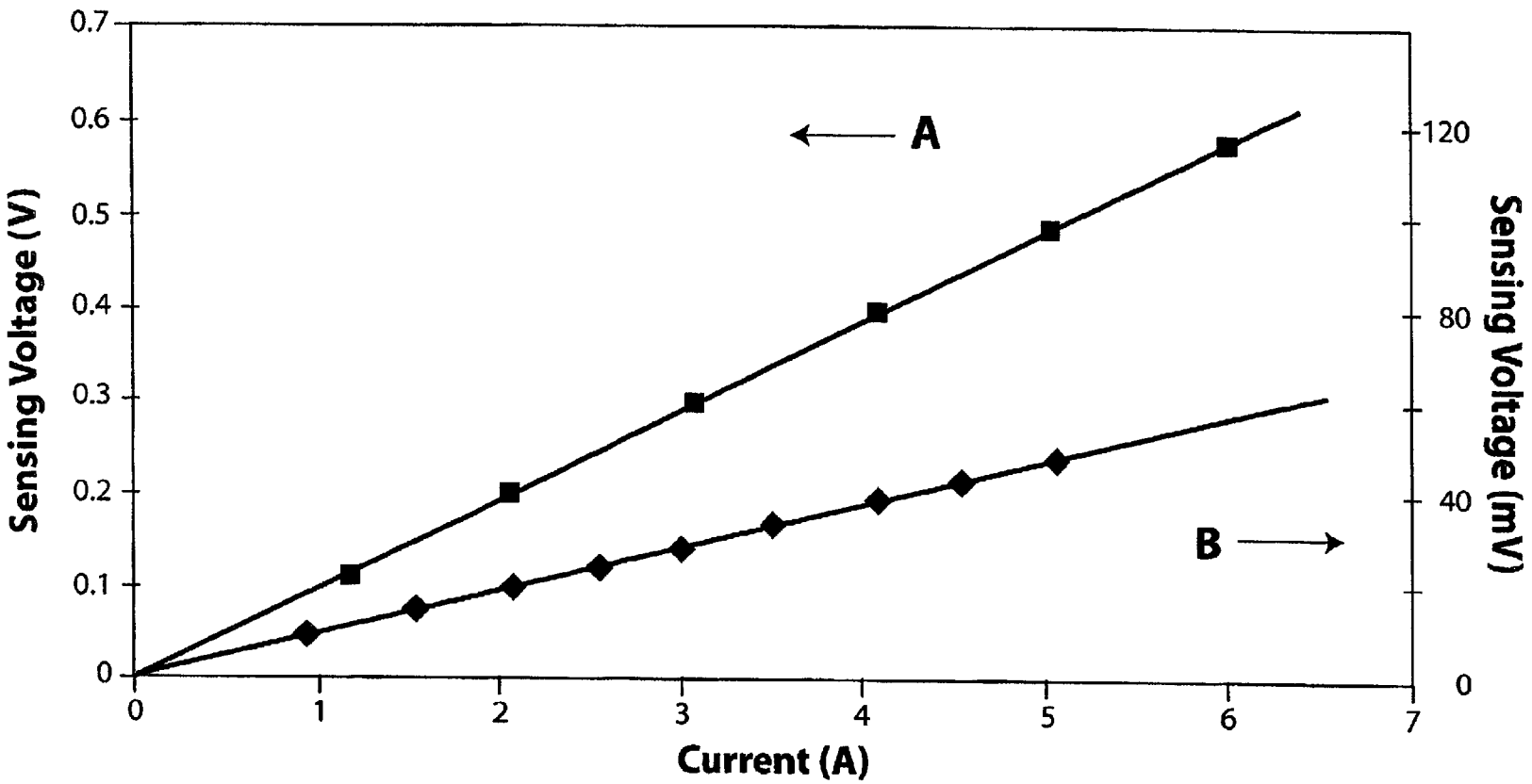
FIG. 5 is a graph depicting the output voltage of the current transformer of FIG. 4.

An inductor prepared in accordance with Example 2 was connected to a voltmeter as in FIG. 4. A copper wire was inserted into the ID (inside diameter) section of the inductor and a 60 Hz current was supplied by a current source. The inductor output voltage was measured as a function of the current from the current source. FIG. 5 is one such example.

Having thus described the invention in rather full detail, it will be understood that such detail need not be strictly adhered to but that various changes and modifications may suggest themselves to one skilled in the art, all falling within the scope of the present invention as defined by the subjoined claims.

What is claim is:

1. A magnetic core, consisting essentially of an amorphous iron-based alloy having composition consisting essentially of about 70–87 atom percent iron, of which up to about 20 atom percent of iron is optionally replaced by cobalt and up to about 3 atom percent of iron is optionally replaced by nickel, manganese, vanadium, titanium or molybdenum, and about 13–30 atom percent of elements selected from the group consisting of boron, silicon and carbon and a saturation induction exceeding about 10 kG (1 tesla), said core having a linear B-H characteristic with a permeability, said permeability being constant within an applied field between −15 Oe and +15 Oe and at a frequency range up to about 1000 kHz.

2. A magnetic core as recited by claim 1 wherein said alloy is in the form of ribbon wound in a toroidal shape to produce said core.

3. An inductor, comprising a magnetic core as recited by claim 2 and a first copper winding on said core.

4. A current transformer, comprising the inductor of claim 3 and an additional copper wire winding on said core, the additional winding being adapted to carry an electrical current to be measured.

5. A current transformer comprising the inductor of claim 3 and an additional copper wire inserted into a hollow geometrically center section of said core, the additional wire being adapted to carry an electrical current to be measured.

6. A current transformer, as recited by claim 4, wherein said first copper winding is adapted to be connected to a voltmeter for measurement of the electrical current in said additional wire winding.

7. A current transformer, as recited by claim 5, wherein said first copper winding is adapted to be connected to a voltmeter for measurement of the electrical current in said additional wire.

* * * * *